United States Patent [19]

Khusnutdinov et al.

[11] 4,390,362

[45] Jun. 28, 1983

[54] METHOD AND APPARATUS FOR OUT-OF-FURNACE TREATMENT OF CAST IRON

[76] Inventors: Gil D. Khusnutdinov, prospekt Vernadskogo, 81, kv. 35; Arkady V. Chernovol, ulitsa Pushkinskaya, 5, kv. 8; Vladimir S. Shumikhin, ulitsa M.Koshevogo, 24, kv. 123; Vasily T. Shulga, ulitsa Schuseva, 3, kv. 3, all of Kiev; Andrei I. Poteiko, ulitsa Zarya, 4, kv. 10; Vladimir K. Kamensky, Gorki-2, ulitsa Rikharda Zorge, 67, kv. 77, both of Kazan; Jury A. Kondakov, ulitsa Rykova, 1/23, kv. 45; Viktor G. Shmigidin, prospekt Vernadskogo, 81, kv. 119, both of Kiev, all of U.S.S.R.

[21] Appl. No.: 319,613

[22] Filed: Nov. 9, 1981

[51] Int. Cl.[3] ..... C21C 7/10

[52] U.S. Cl. ..... 75/49; 266/208

[58] Field of Search ..... 266/208; 75/49

[56] References Cited

U.S. PATENT DOCUMENTS

| | | | |
|---|---|---|---|
| 3,013,316 | 12/1961 | Hornak | 75/49 |
| 3,182,359 | 5/1965 | Gero | 75/49 |
| 3,700,026 | 10/1972 | Adachi | 266/208 |
| 3,779,743 | 12/1973 | Olsson | 75/49 |
| 3,790,368 | 2/1972 | Olsson | 75/49 |

*Primary Examiner*—P. D. Rosenberg

*Attorney, Agent, or Firm*—Murray Schaffer

[57] ABSTRACT

A molten metal is fed into a ladle and subjected to vacuum while being treated with inoculating additives. The application of vacuum is carried out prior to the beginning of interaction between the melt and the inoculating additives, and is conducted continuously for 15 to 120 seconds in the course of this interaction. A receiving tank is provided with a discharge opening which is closed with an insert, a ladle having load trunnions is disposed under this tank with a sealable chamber. A system of air evacuation is provided for the chamber whereby on disintergration of the insert the molten metal with tank enters the chamber and is subjected to the vacuum.

12 Claims, 11 Drawing Figures

METHOD AND APPARATUS FOR OUT-OF-FURNACE TREATMENT OF CAST IRON

BACKGROUND OF THE INVENTION

1. Field of the Invention

The invention relates to the art of metallurgy and foundry production, and particularly to production technology and equipment for out-of-furnace treatment of cast iron (ladle treatment), conducted next to melting the cast iron and designed for upgrading its mechanical properties. The invention may prove most advantageous in producing cast iron having such compact forms of graphite as spheroidal and lamellar.

2. Description of the Prior Art

Due to its high mechanical properties, cast iron having compact forms of graphite finds ever increasing application and production. Those skilled in the art face an important problem which consists in the upgrading of the mechanical properties of cast iron in combination with a decreasing of the expenditures required for its manufacture, and for ensuring high capacity of the production process.

The prerequisite for producing cast iron having spheroidal and lamellar graphite is the deep refining of the cast iron to remove undesirable impurities which would lower its mechanical characteristics, primarily from sulphur and oxygen. It is well known that such a refining may be achieved either by the long-term holding of the iron melt under conditions of high vacuum (of the order of $10^{-2}$ mm Hg) or by introducing various inoculating additives into the melt, e.g. metallic magnesium, cerium, yttrium, calcium, or their mixtures with other elements (master alloys).

The long-term holding of metallic melts, particularly steel and iron, under high vacuum has been known for a comparatively long time (British Patent Specification No. 956,678 and USSR Author's Certificates Nos. 382,695; 440,423; 444,817), though it is applied as a rule only under laboratory conditions which fact is explained by a comparatively high cost of vacuum installations and by a considerable lengthening of the production process.

For this reason, to upgrade the mechanical properties of iron in industrial quantities, it is treated with inoculating additives, mainly magnesium and magnesium-containing master alloys, which are now the most efficient inoculants (USSR Author's Certificates Nos. 500,232; 521,317; 709,690; 749,900).

It should be noted however, that the treatment of iron with metallic magnesium is associated with considerable difficulties since it is accompanied by vigorous "boiling" of the melt, its outbursts from the ladle, bright flashes and abundant gas and fume emissions, all of which deteriorate considerably working conditions for the personnel. Moreover, as magnesium interacts with the ambient oxygen, there takes place intensive, explosion-like burning of magnesium. This results finally in the ineffective consumption of the inoculant, and the formation of in atmospheric pollution.

To reduce the above-mentioned effects encountered in the treatment of iron with metallic magnesium, various devices described in technical literature are used (K. I. Vashchenko, L. Sofroni, Magnievyi chugun, Moscow-Kiev, Mashgiz, 1960, pp. 131–170). However, some of them (ladles provided with massive covers, rotary ladles, ventilated chambers) do not eliminate the contact between inoculating additives and atmospheric oxygen, and abundant emission of gas and fume, thereby resulting in increased consumption of magnesium, while other devices (autoclaves, sealed ladles) though eliminating the above difficulties, are inefficient and hard to operate since they require frequent replacements or readjustments of some assemblies.

It has been also proposed to treat liquid iron by immersing a porous material impregnated with magnesium thereinto, said porous material being particularly coke (French Pat. No. 2,004,076) or a porous refractory material (British Patent Specification No. 1,048,909). However, these methods of treatment have not found wide practical application because of their low efficiency.

Methods of treating cast iron with magnesium-containing master alloys provide for a less intensive process of interaction between the melt and the inoculant than in the application of pure magnesium. For this reason, in application of these methods a simpler equipment in usually employed. Introducing master alloys into the iron melt is carried out in different ways: by immersing billets fixed on bars, into the melt; by feeding a crushed master alloy onto the melt stream while discharging iron from the furnace or pouring iron from one ladle into another; by utilizing sinking pellets supplied to the melt surface (when the density of a master alloy is higher than that of the melt); by charging a master alloy to the bottom of the ladle prior to hot metal charging, etc.

However, in practicing these methods, the contact between inoculating additives and the atmospheric air is also possible, thereby resulting in increased consumption of the additives, formation of considerable amount of slags, and an increase in the amount of undesirable bursts into the atmosphere. Moreover, the application of master alloys in the form of sinking pellets is associated with the use of such expensive and scarce ingredients are copper and nickel.

Also known in the art is a method of intramould treatment of iron (inmould process) wherein inoculating additives utilized as a rule in the form of master alloys are located within a reaction chamber being a part of the gating system of a mould (see Sillen R. Inmold Nodulization with Delayed Pouring in Vertically Ported Molds. Modern Casting, 1979, July, pp. 58–59).

In this method, the process of treating iron proceeds in the course of charging the mould with the melt. Such a production process, though limiting oxidation of the atmospheric oxygen and considerably reducing emission of gases and fumes, has its significant problems which are caused by the fact that the process of inoculation proceeds separately for each casting.

The above consideration results in the necessity of checking each casting from the viewpoint of the degree of spheroidization of graphite in the metal structure. Moreover, with such a method a deep preliminary desulphurization of iron is required, and an additional consumption of iron for filling the reaction chamber with the melt takes place.

Finally, known in the art is a method of out-of-furnace treatment of iron, which combines both above-mentioned kinds of treatment: with inoculating additives and under vacuum conditions (Japanese Patent Specification No. 45-17967). According to this method, magnesium and/or calcium and/or cerium in the metallic form or compounds and mixtures containing at least one of the above elements are added to molten iron as inoculants. Following this, the melt is held under rough vacuum (of the order of 50 mm Hg) for about 5 minutes. Such a combined treatment makes it possible, from one hand, to eliminate utilization of high vacuum, and from the other hand, to lower the consumption of inoculating additives, and at the same time provides for the possibility of preparing iron having fine-grained graphite.

This method can be partially practiced (namely, from the viewpoint of degassing the melt), e.g. by means of an apparatus comprising a receiving tank provided with a discharge opening closed with an insert, a ladle having load trunnions, and a sealable chamber provided with a branch pipe for connecting to a system of air evacuation (USSR Author's Certificate No. 608,839).

The sealable chamber of the above apparatus is a non-detachable shell of a substantially cylindrical form and having a slightly expanded lower portion, disposed vertically and abutting with the upper end face thereof to the lower side of the receiving tank. The lower end face of the shell is hermetically connected to the housing of the ladle for which end the upper portion of the latter is provided with a bearing flange and a sealing gasket. Inside this metallic shell is disposed another shell from a refractory material, converging in the downward direction and entering the neck of the ladle. Thus, on the way of the stream of molten metal moving from the receiving tank towards the ladle is formed an enclosed space defined by the walls of the sealable chamber, in which space a vacuum is established in the process of operation. The ladle is brought under the sealable chamber by means of an industrial truck, and the tightness of abutting the chamber and the ladle is achieved by hydraulic jacks provided in the apparatus.

The above described apparatus operates as follows. In the course of feeding a molten metal into the receiving tank, a hydraulic seal is created within a zone of the discharge opening thereof, thereby providing for the possibility of establishing a required vacuum within the sealed chamber. Following the fusion of the insert closing the above opening, the molten metal goes through the refractory shell where it is subjected to the effect of vacuum, and enter into the ladle.

In spite of the fact that the above method practiced by means of the above described apparatus makes it possible to somewhat upgrade the properties of cast iron, some serious problems arise in practicing this method. Thus, since the introduction of inoculating additives into the molten metal is accomplished prior to performing the vacuum treatment, the process of refining the molten metal from sulphur and oxygen proceeds primarily through the consumption of the inoculating additives. Subsequent degassing the molten metal treated with the additives results only in the intensive evaporation of the inoculating additives since it lowers the boiling temperature of the reagents. The above fact has a particular effect on the removal of magnesium, being the most effective inoculant, from the molten metal, since its boiling temperature is lower than the temperature of the liquid cast iron.

Moreover, degassing for above specified time (5 minutes) is too prolonged since, as investigations have demonstrated, it causes a decrease in the content of the inoculant additives in the molten metal. As a result of the above specified problems, the cast iron produced by such a production process possesses rather low mechanical properties, the consumption of the inoculating additives is rather significant, and the process capacity is relatively low.

It should be also noted that since in the prior art apparatus practicing the above described production process the sealable chamber is made non-detachable and, being a through one, is disposed between the receiving tank and the ladle, the path of the flow of the molten metal from the receiving tank to the ladle is too long, and the molten metal loses a considerable portion of its thermal energy. For this reason, in the cases where the treatment of the molten metal is conducted by frequently repeating cycles and in comparatively small amounts, which is characteristic of machine-building plants, there may occur "freezing" of the molten metal on the surface of the inoculating additives. With such a treatment, the inoculation of the molten metal does not give satisfactory results; moreover, the molten metal will have a relatively low temperature and a poor yield, which substantially impedes its subsequent pouring into the moulds.

It should be also pointed out that the prior art apparatus has a low reliability. This fact is caused by an increased damageability of the ladle flange and of the sealing gasket provided thereon in the course of discharging the treated molten metal through the ladle pouring lip, e.g. when filling the moulds. The above circumstance results in the necessity of restoration of these components of the apparatus prior to conducting next cycles of the non-furnace treatment of the molten metal, which fact practically eliminates the possibility of utilization of this apparatus under conditions where the duration of cycles and breaks between them is only 5–7 minutes.

A low reliability of this apparatus is also caused by the fact that one more sealing gasket is an indespensable component thereof, said gasket being disposed between the receiving tank and the sealable chamber, i.e. within the zone subjected to significant thermal loadings. In a frequent repetition of treatment cycles, such a gasket is also subjected to intensive wear.

Finally it should be noted that the above described apparatus for out-of-furnace treatment of cast iron has a comparatively low capacity and can operate only together with load lifting mechanisms, since it requires a large number of auxiliary crane operations.

SUMMARY OF THE INVENTION

The main object of the present invention is to provide a method and apparatus for out-of-furnace treatment of cast iron; obtaining a cast iron having high mechanical properties in combination with low consumption of inoculating additives.

A further object of the present invention is to provide a method and an apparatus allowing abundant gas and fume emissions to be eliminated in the process of treatment of cast iron, and the amount of undesirable bursts into the atmosphere to be reduced.

A further object of the present invention is to provide a method and an apparatus ensuring high capacity of producing cast iron under conditions of frequently repeating cycles within a ladle.

Another object of the present invention is to provide a method which is simple to practice, and an apparatus for out-of-furnace treatment of cast iron, which is easy in manufacture and reliable in operation.

The objects set forth and other objects of the present invention are attained by that in a method of out-of-furnace treatment of cast iron, wherein a molten metal, which is fed into a ladle, is subjected to the effect of inoculating additives and a vacuum, according to the invention, the process of degassing the molten metal is carried out prior to the beginning of interaction between the latter and the inoculating additives and in the course of this interaction, and is conducted continuously for 15 to 120 seconds.

Degassing the molten metal in vacuum prior to the beginning of its interaction with the inoculating additives ensures partial degassing of the molten metal, which fact results in particular in reducing the content of oxygen. This results in a decrease in the consumption of the inoculating additives required for bonding oxygen which has remained in the molten metal, and consequently in a decrease in the total consumption of the inoculant.

Vacuumizing the molten metal carried out in the process of interaction between the latter and the inoculating additives prevents the contact between the atmospheric oxygen and the additives, thereby eliminating their ineffective consumption for combustion and significantly reducing the amount of gas and fume emissions.

The continuity of vacuum degassing, which is revealed in the absence of a break between the operations of degassing and treatment with inoculating additives, makes it possible to eliminate the intake of oxygen into the molten metal during such a break.

Selected duration of the process of treating with vacuum is optimum. In the case where this duration is less than 15 s, the inoculating additives do not have enough time to be assimilated by the molten metal under conditions of vacuum, and the process of their interaction with the molten metal continues to proceed intensively under atmospheric conditions, thereby resulting in the appearance of bright flashes and significant gas and fume emissions on the surface of the molten metal. In the case where the duration of degassing is more than 120 s, a considerable amount of inoculating additives, and magnesium first of all, has enough time to evaporate from the molten metal, which fact results in deterioration of mechanical properties of the produced cast iron.

It is expedient to carry out vacuum treatment of the molten metal prior to its interaction with the inoculation additives, within the stream during supply of the molten metal into the ladle, and to carry out treatment with these additives within the ladle, while continuing degassing the molten metal disposed therewithin.

For the above described comparatively short time of treatment, the vacuum treatment of a stream is the most effective method of degassing the molten metal, since it provides for batch-type process and is practiced by means of comparatively simple devices. Inoculating the molten metal within the ladle provides for the possibility of introducing the inoculating additives below the level of the molten metal which fact, due to the presence of a hydrostatic head, reduces the amount of evaporating additives, magnesium first of all. The continuation of vacuum treatment in the process of inoculation prevents oxidation of the inoculant by the atmospheric oxygen.

It is desirable to place the inoculating additives in a layer onto the bottom of the ladle prior to supply of the molten metal thereinto, and to monitor the process of their interaction with the molten metal by removing a portion of heat which comes to said layer of additives from the molten metal.

Laying the inoculating additives in a layer onto the ladle bottom prior to the beginning of supplying the molten metal into the ladle is the simplest method permitting the interaction between said additives and the molten metal during subsequent filling the ladle, since it does not require the application of additional devices for immersing the inoculants into the molten metal (evaporating bells and billets mounted on rods) or special reaction chambers for disposing the inoculant, which require frequent replacements and readjustments.

Controlling the process of interaction between the additives and the molten metal by removing a portion of heat which comes to the layer of additives from the molten metal, makes it possible to lower the temperature at which the molten metal penetrates into the layer of additives, and thereby to increase viscosity of the molten metal. The above fact prevents the drifting of the inoculating additives from the ladle bottom to the surface of the molten metal, and thereby reduces evaporation of the inoculants.

Heat removal may be accomplished by various methods. In particular, this removal can be carried out by contacting the molten metal with a metallic radiator which is laid onto the ladle bottom prior to charging inoculating additives thereinto. This method is very simple to practice and sufficiently effective since the heat being transferred by the molten metal to the layer of additives, is partially removed for heating the radiator possessing high thermal conductivity.

Heat removal may be also accomplished by varying the consumption of the molten metal supplied into the ladle from a minimum magnitude at the initial stage of filling the ladle, corresponding to the time of lifting the level of the molten metal contained within the ladle to the surface of the layer of the inoculating additives, to a maximum value during further filling said ladle.

Due to a decreased consumption of the molten metal at the initial stage of filling the ladle, as compared with a subsequent value of consumption, said stage is prolonged, thereby resulting in a decrease in the intensity of heat inflow to the layer of the inoculating additives, and consequently in reduction of evaporation of the inoculant.

It is expedient to vary the consumption of the molten metal by changing the diameter of the stream of molten metal supplied into the ladle from a minimum value at the initial stage of filling the ladle to a maximum value in the course of its further filling. Such a method of controlling the consumption is the simpliest.

The objects set forth and other objects of the present invention are further attained by that in an apparatus for out-of-furnace treatment of cast iron, comprising a receiving tank provided with a discharge opening closed with an insert, a ladle having load trunnions, a sealable chamber with a branch pipe for connecting to a system of air evacuation and coupled with the receiving tank so that there is provided an enclosed space therebetween, said space being defined by the walls of this chamber, according to the invention, the discharge opening of the receiving tank has a diameter determined from the following condition: $D=K\sqrt{V}$, where D is a diameter of this opening, mm; V is a volume of the molten metal being treated, $dm^3$; K is a proportionally factor whose magnitude is from 1.5 to 5.

The investigations have demonstrated that with such diameter of the discharge opening, the flow of the whole mass of the molten metal being treated from the receiving tank into the ladle under conditions of vacuum is carried out during a predetermined time of degassing (from 15 to 120 s).

The inventive apparatus can be constructed in accordance with a modification wherein it is provided with a flat metallic grate serving as a radiator, the height of said gate substantially coinciding with that of the layer of inoculating additives, and its dimensions and plan shape corresponding to those of the ladle bottom.

With such an arrangement of the apparatus, an uniform removal of heat is achieved from the molten metal to the radiator over the whole area of the ladle bottom and over the whole height of the layer of inoculating additives.

Especially effective in operation when practicing the inventive method with a varying diameter of a stream of the molten metal is such a modification of the apparatus wherein an opening is provided within the insert, the diameter of said opening corresponding to a smaller diameter of the stream, and disposed, with the insert being mounted, in substantially coaxial relationship with the discharge opening of the receiving tank, which opening determines the greater stream diameter, the diameter of the opening provided within the insert being of from 0.2 to 0.3 of the diameter of the discharge opening of the receiving tank.

The above modification of the apparatus makes it possible to accomplish the removal of heat from the molten metal prior to its getting onto the layer of inoculating additives, since through the decrease in the diameter of the stream of molten metal at the initial stage of filling the ladle, the specific radiating area of the molten metal increases, thereby increasing its heat losses on the way to the layer of additives. The necessity of application of additional heat removing devices is thus eliminated.

The selected magnitude of the diameter of the opening provided within the insert is optimum. In the case where this diameter is less than 0.2 of the diameter of the discharge opening of the receiving tank, "freezing" of the molten metal within this opening may occur, thereby reducing operation reliability of the apparatus.

In the case where this diameter is more than 0.3 of the diameter of the discharge opening, there exists the possibility of premature floating of the inoculating additives from the layer to the surface of the molten metal since the molten metal will be supplied to the layer in a too hot state and will be less viscous. Premature floating of the inoculant may lead to its excessive consumption.

It is expedient to construct the inventive apparatus in accordance with a modification wherein it is provided with at least two working positions and has a corresponding number of said ladles, one said receiving tank and one said sealable chamber. Said chamber is made detachable and comprises in each of the above positions a housing and a cover, both provided with connecting flanges. The number of the housings in the apparatus corresponds to the number of its working positions, and each housing is mounted stationary with respect to other ones and serves for receiving the ladle therewithin. The cover is single for all the working positions and is constructed integral with the receiving tank in the form of the bottom portion thereof and a shell projecting below this bottom portion. Said shell is disposed concentrically relative to openings provided in the bottom and said insert. The apparatus is further provided with a displacing mechanism for shifting the receiving tank to a required position and for forming in this position a sealable chamber by jointing together the shell and a corresponding housing. The height of location of a connecting flange on each of these housings and the height of location of load trunnions on each of the ladles are such that with the ladle mounted into the sealable chamber, the trunnions of said ladle are disposed at the level of the flange of the housing.

With such an arrangement, the apparatus possesses high capacity and performance reliability and allows the inventive method to be practiced under conditions of frequently repeating cycles of out-of-furnace treatment of cast iron.

Rather effective is such a modification of the apparatus wherein the displacing mechanism is constructed as a column with a cantilever mounted thereon and connected to said receiving tank, and a drive for progressive and rotary motion coupled with this cantilever for shifting the latter in vertical and horizontal planes relative to the above housings.

With such an arrangement, the apparatus is relatively compact, simple in the manufacture and hancy in operation.

BRIEF DESCRIPTION OF DRAWINGS

A fuller understanding of the nature of the invention will be had from the following detailed description of the inventive method and apparatus, taken in conjunction with the accompanying drawings, in which:

FIG. 4 shows the apparatus at the moment of supplying a molten metal into the receiving tank;

FIG. 5 illustrates the process of flowing the molten metal from the receiving tank into the ladle;

FIG. 6 shows the apparatus at the moment of termination of filling the ladle;

FIG. 8 shows the initial step of supplying a molten metal into the sealable chamber of the inventive apparatus, when a working vacuum in this is not yet achieved and the molten metal flows in a thin stream;

FIG. 9 illustrates the next step of supplying a molten metal, when a working vacuum is provided within the sealable chamber, and the molten metal flows in an open stream;

FIG. 10 illustrates the final step of supplying a molten metal, when the insert has dissolved in the molten cast iron, and the melt flows in a broad stream;

DETAILED DESCRIPTION OF THE INVENTION

Figure 1:
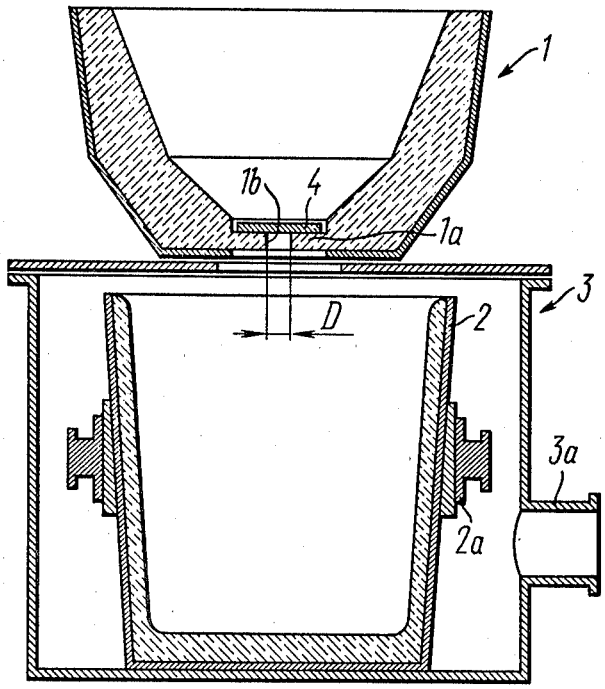
FIG. 1 shows a longitudinal section of the apparatus for practicing the method of out-of-furnace treatment of cast iron, of the invention.

The inventive apparatus for practicing the claimed method of out-of-furnace treatment of cast iron comprises a lined receiving tank 1 (FIG. 1), a ladle 2 provided with load trunnions 2*a*, and a sealable chamber 3 provided with a branch pipe 3*a* for connecting to a system of air evacuation (not shown). The receiving tank 1 is jointed together with the chamber 3 through a sealing gasket (not shown) and is provided with a discharge opening 1*b* in a bottom 1*a*. This opening 1*b* is closed with an insert 4 made, particularly, from cast iron.

According to the invention, the selection of a diameter of the discharge opening 1*b* is carried out from the condition: $D=K\sqrt{V}$, where D is a diameter of this opening, mm; V is a volume of a molten cast iron being treated, $dm^3$; K is a proportionality factor selected within a range from 1.5 to 5 depending on a predetermined time of treating the molten metal. Thus the selected diameter of the discharge opening 1*b* of the receiving tank 1 ensures a required duration of degassing, which duration, according to the invention, should be from 15 to 120 s depending on a mass of the molten metal being treated, a composition of inoculating additives, and some other factors.

Figure 2:
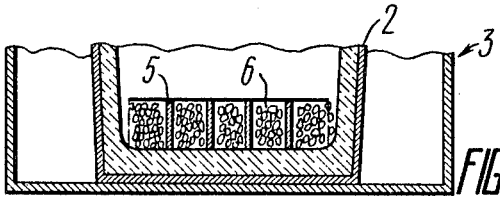
FIG. 2 shows a longitudinal section of the lower portion of the ladle of the inventive apparatus, with the metallic grate mounted within this ladle.
Figure 3:
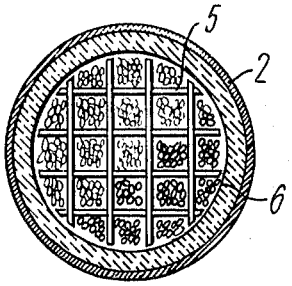
FIG. 3 shows the same as FIG. 2, plan view.

It is rather useful to provide a metallic grate 5 in the inventive apparatus (FIGS. 2 and 3), said grate serving as a radiator in the process of inoculating the molten metal. This grate 5 is employed in those cases where in accordance with the inventive method, the inoculating additives are put in a layer 6 (FIG. 2) onto the bottom of the ladle 2 prior to the beginning of the supply of molten metal. In this case the grate 5 is mounted onto the bottom of the ladle prior to charging said additives, the latter being charged into the cells of the grate 5. The height of the grate 5 substantially coincides with a predetermined height of the layer 6 of the inoculating additives as can be seen in FIG. 2, the dimensions and plan shape of said grate corresponding to those of the ladle 2 (FIG. 3).

Figure 4:
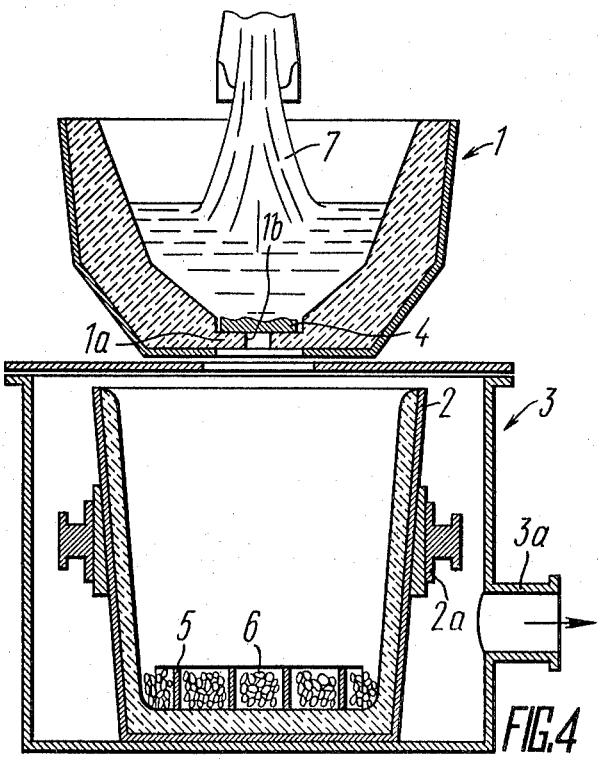
FIGS. 4 through 6 illustrate the steps of the inventive method practiced by means of the inventive apparatus, with the presence of the metallic grate within the ladle thereof (in these and following figures the arrow shows the direction of air evacuation)
Figure 6:
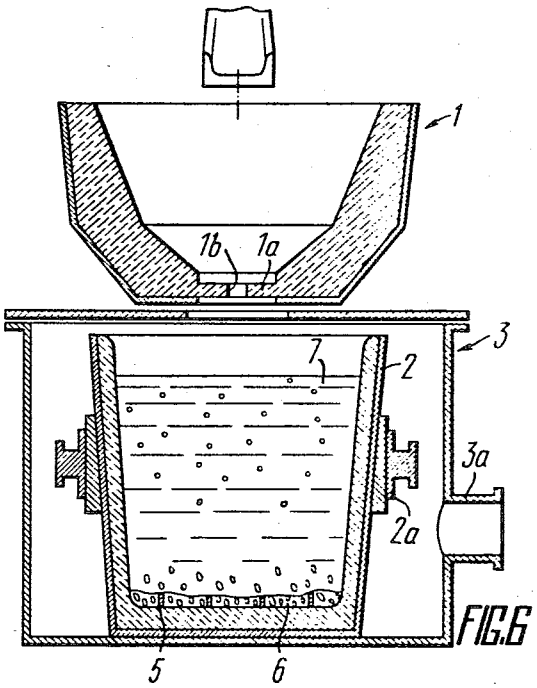
Figure 5:
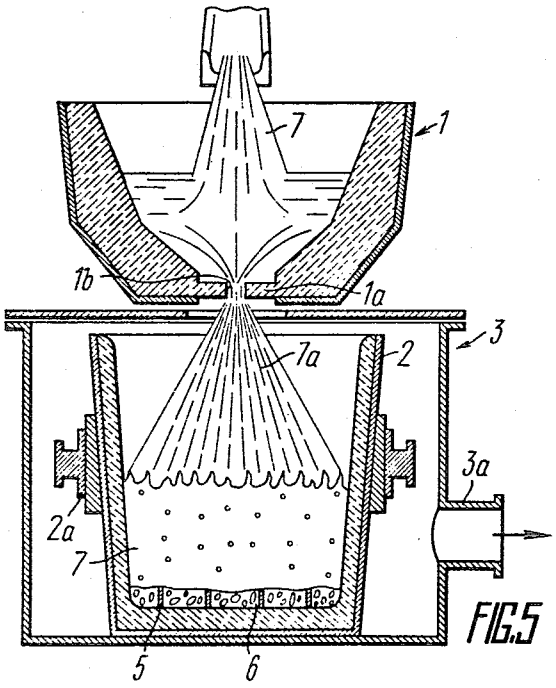

The inventive method of out-of-furnace treatment of cast iron is practiced, using the above described apparatus, as follows (FIGS. 4 through 6). At first, the grate 5 is installed into the ladle 2, and the inoculating additives 6 are charged as described above. The composition and amount of said additives are determined depending on the mass and starting characteristics of the molten metal to be treated, required properties of cast iron, desired capacity of the production process, and other factors.

Next, a molten metal 7 to be treated is fed into the receiving tank 1 whose discharge opening 1*b* is closed with the insert 4 (FIG. 4). The molten metal 7 may come into the apparatus directly from an iron runner 8 of a melting furnace, as shown in the given figure (the furnace itself is not shown), or may be supplied to the location of treatment by means of some intermediate ladle. Upon filling the bottom portion of the receiving tank 1, the molten metal creates a hydraulic seal within the region of the discharge opening 1*b*, thereby eliminating the possibility of penetration of air into the sealable chamber 3 through leakages between the insert 4 and a portion of the bottom of the tank 1 adjacent this opening.

From the moment of formation of the hydraulic seal, the chamber 3 becomes completely sealed (provided that tightness of other elements of the apparatus is ensured). With the connection of the chamber 3 through the branch pipe 3*a* to the system of air evacuation, a vaccum begins to be supplied within this chamber.

Simultaneously with evacuation of air there occurs a gradual heating of the insert 4 by the molten cast iron 7, its melting down (FIG. 5) and subsequent dissolution in the molten metal (FIG. 6). The material and mass of the insert 4 are so selected that melting down of the latter, and hence the supply of the molten metal 7 into the chamber 3 do not occur before a working vacuum is achieved within this chamber (from 5 to 20 mm Hg).

After the predetermined vacuum is established within the sealed chamber 3, a hole is melted in the insert 4 and the molten metal 7 starts coming in a stream 7*a* from the receiving tank 1 into the ladle 2 onto the layer 6 of the inoculating additives (FIG. 5). The initial moment of pouring the molten metal 7 from the receiving tank 1 can be determined from the lowering of the level of the molten metal within said tank. In this case, if a volume of the receiving tank 1 is less than that of the whole molten metal 7 to be treated, the latter is added to this tank gradually as the level of the molten metal therewithin lowers, while not allowing the atmospheric air to penetrate into the chamber 3 in the process of pouring.

The stream 7*a* of the molten metal, while passing the distance from the discharge opening 1*b* of the receiving tank 1 to the surface of the layer of the inoculating additives 6, is subjected to the effect of vacuum, which results in a partial degassing thereof prior to the beginning of interaction between the molten metal and inoculant. The stream 7*a*, under the effect of gases being removed, and under conditions of vacuum, is opened and takes the form close to that of a cone whose apex is located at the discharge opening 1*b* of the receiving tank 1. With such a form of the stream 7*a*, the molten metal is supplied uniformly to the layer 6 of the inoculating additives and to the grate 5.

A portion of the heat of the molten metal 7 is consumed for heating and subsequent partial melting down the grate 5. For this reason, the molten metal 7 starts interacting with the inoculating additives 6 in a partially cooled state and possessing an elevated viscosity. Due to such removal of heat from the molten metal 7, the evaporation of the inoculant is significantly slowed down. Moreover, the probability of separation of a portion of the inoculating additives from the layer 6 and their floating in the course of further filling the ladle 2 with the molten metal 7 is reduced since a viscous, semi-liquid molten metal creates a binding envelope around these additives, thereby retaining them below the level of the molten metal 7.

A vacuum is maintained within the chamber 3 during the entire time of pouring the molten metal 7 from the receiving tank 1 into the ladle 2. Being already within the ladle 2 and interacting with the inoculant, the molten metal 7 continues being degassed, which fact causes its "boiling" accompanied by vigorous stirring the molten metal 7 in the course of lifting the level thereof within the ladle 2 above the layer 6 of the inoculating additives. This stirring and a partial evaporation of the inoculant result in the erosion of the layer 6 and a semi-liquid envelope of the molten metal 7, which has appeared therearound. Therefore, in the process of filling the ladle 2 with the molten metal 7, there occurs a gradual dissolution of the inoculating additives 6. It is to be noted that this dissolution takes place mainly under the level of the molten metal 7, in the presence of a certain hydrostatic head which fact also promotes a decrease in the ineffective consumption of the inoculant (for evaporation).

Thus, the process of degassing the molten metal 7 starts in that portion of the introduced molten stream 7*a* prior to the beginning of interaction between said molten metal and the inoculant, and continues within the ladle 2 (from the total amount of the molten metal contained therewithin) in the course of this interaction. The total duration of degassing the molten metal 7 or, which is substantially the same, the duration of the process of its interaction with the inoculant under the conditions of vacuum, is determined by the time of pouring the molten metal 7 from the receiving tank 1 into the ladle 2, while maintaining the hydraulic seal within the zone of the discharge opening 1*b* and is, as above indicated, from 15 to 120 s. Since this time (under insignificant variations in the level of the molten metal 7 contained within the receiving tank 1) depends mainly on a diameter D of the discharge opening 1*b*, a properly selected diameter (according to the recommended dependence $D=K\sqrt{V}$) ensures obtaining good results of treatment, i.e. high mechanical properties of the produced cast iron, combined with a low consumption of the inoculant and a small amount of gas and fume emissions.

A too small diameter of the discharge opening 1*b* (with K being less than 1.5) may prolong the duration of degassing to such an extent that the major portion of the ingredients shifted from the inoculant into the molten metal 7, will be evaporated from the latter during this time. This fact will result in deterioration of the properties of cast iron thus produced.

A too large diameter of the discharge opening 1*b* (with K being more than 5) does not ensure effective degassing of the molten metal 7 within the stream, and in addition causes an abundant gas and fume emission, since due to a rapid filling of the ladle 2 the metallic grate 5 has no time to cool the molten metal 7 to a required degree, thereby resulting in the floating of the inoculating additives to the surface of the melt and the burning of said additives while joining the oxygen contained in the air, which has come into the chamber 3 after the process of pouring off the molten metal 7 had terminated.

In FIG. 6 the above described apparatus is shown at the moment of termination of the process of pouring the molten metal 7 from the receiving tank 1 into the ladle 2. As can be seen in this figure, the insert 4, the inoculating additives 6, and the grate 5 have completely (or almost completely) dissolved in the molten metal 7, and there is no hydraulic seal within the zone of the discharge opening 1*b*. Together with the last batches of the molten metal 7, air starts coming into the chamber 3, i.e. this chamber gets depressurized. By this moment the branch pipe 3*a* is disconnected from the system of air evacuation. As the air comes into the chamber 3, the pressure therewithin is equalized to the atmospheric one, and the process of degassing the molten metal 7 stops.

The removal of heat from the molten metal 7 can be carried out not only by contacting the molten metal with the metallic grate 5 as described above, but also by varying the flow rate of the molten metal 7 being poured into the ladle 2 from a minimum value at the initial stage of filling the ladle 2 (corresponding to the time of lifting the level of the molten metal 7 to the surface of the layer 6) to a maximum value in the course of its further filling. It can be carried out in the simpliest way by changing a diameter of the stream of the molten metal 7.

Figure 7:
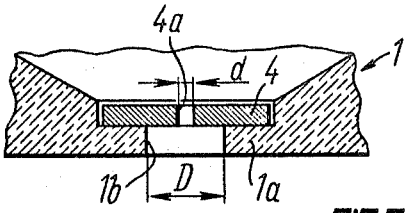
FIG. 7 shows in detail a zone of the discharge opening provided in the receiving tank of the inventive apparatus made in accordance with a modification wherein an opening is provided in the insert mounted within this tank.
Figure 8:
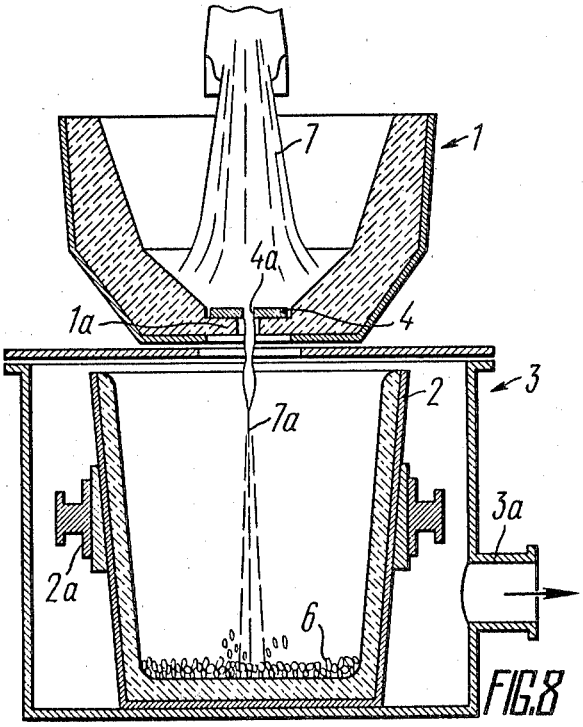
FIGS. 8 through 10 illustrate the steps of the inventive method practiced by means of the apparatus made in accordance with FIG. 7.
Figure 10:
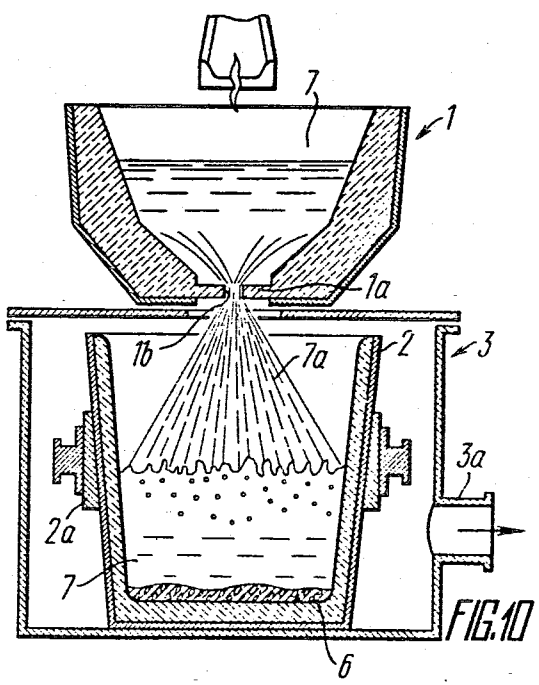
Figure 9:
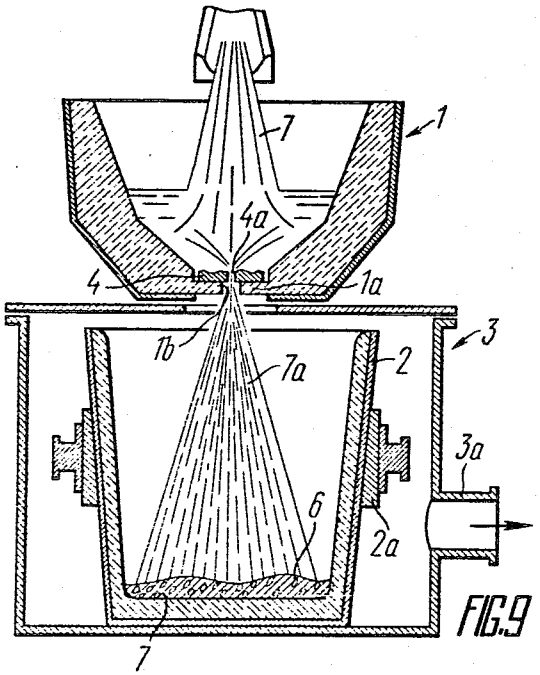

For the purpose of practicing such a production process, the apparatus is constructed in accordance with the modification illustrated in FIGS. 7 through 10. In accordance with this modification, within the insert 4 is provided an opening 4*a* having a diameter of d, which is from 0.2 to 0.3 of the diameter D of the discharge opening 1*b* of the receiving tank 1. The insert 4 being installed, both the openings 4*a* and 1*b* are located substantially along one axis, the diameter d determining a smaller diameter of the stream 7*a* of the molten metal 7, namely its diameter at a region adjacent the lower side of the insert 4 at the initial stage of filling the ladle 2 (FIG. 9), while the diameter D determines a larger diameter of this stream 7*a* in the course of further filling (FIG. 10). To prevent shifting the insert 4 under the action of the stream of the molten metal 7 during its supply into the receiving tank 1, the refractory lining of the bottom of the latter is provided with a recess to receive this insert 4 as shown in FIG. 7.

Now consider in greater detail the process of treatment of a molten cast iron with the utilization of the above modification of the apparatus. In the course of supplying the molten metal 7 into the receiving tank 1 (FIG. 8), a hydraulic seal is established in the zone of location of the insert 4, following which the chamber 3 is connected to a system of air evacuation. However, unlike the above described method of treatment (FIGS. 4 through 6), the molten metal 7 starts coming into the ladle 2 prior to the moment of achievement of a working vacuum within the chamber 3, through the opening 4*a* provided in the insert 4. During this process the stream 7*a* of the molten metal 7, flowing out of the receiving tank 1, will be comparatively thin due to an insufficient vacuum established within the chamber 3 (a certain time is required to create a working vacuum, said time corresponding, as indicated above, to that of melting down the insert 4).

In the course of further evacuation of air, the degree of vacuum within the chamber 3 increases, and the stream 7*a* of the molten metal 7 acquires a conical form (FIG. 9), though its diameter in the narrowest region is still determined by a diameter of the opening 4*a* provided in the insert 4. Since this opening is substantially coaxial with the opening 1*b* of the receiving tank 1, the conical shape of the stream 7*a* is not disturbed in the course of departure of the latter out of the opening 4*a*, thereby ensuring a uniform supply of the molten metal 7 to the surface of the layer 6 of inoculating additives.

In the course of flowing the molten metal 7 out of the receiving tank 1 through a comparatively small opening 4*a*, the stream 7*a* possesses a large specific surface area (i.e. a surface per unit of mass), and hence it loses a considerable portion of heat due to radiation of the latter on the way from the insert 4 to the layer 6 of inoculating additives. For the above reason, the molten metal 7, when coming to the layer 6, has a lower temperature and a higher viscosity at this stage than afterwards. The action of such a molten metal 7 is similar to that described above for the metallic grate 5 (FIGS. 4 through 6). A semi-liquid envelope of the molten metal 7 (FIG. 9), thus formed around the inoculating additives 6 at the initial stage of filling the ladle 2, prevents their floating in the course of further filling as well.

As it can be understood from the above, the duration of the initial stage of filling the ladle 2 is determined by a diameter d of the opening 4*a* provided in the insert 4, said diameter being selected within a recommended range. The experiments have proved that in the case where d is less than 0.2 D, the molten metal may sometimes "freeze" within the opening 4*a;* in the case where d is more than 0.3 D, the probability of premature flotation of a portion of inoculating additives to the surface of the molten metal 7 contained within the ladle 2, increases.

By the moment when the level of the molten metal 7 within the ladle 2 reaches the surface of the layer 6 of inoculating additives, the insert 4 is completely dissolved by the molten metal 7 contained within the receiving tank 1 (FIG. 10), and the ladle is further filled directly through the discharge opening 1*b*. In the course of this filling, the molten metal 7 flows in a broad stream 7*a* and carries a larger amount of the thermal energy to the inoculating additives than at the initial stage of filling the ladle 2. Following this, the process proceeds as shown in FIGS. 4 through 6.

Figure 11:
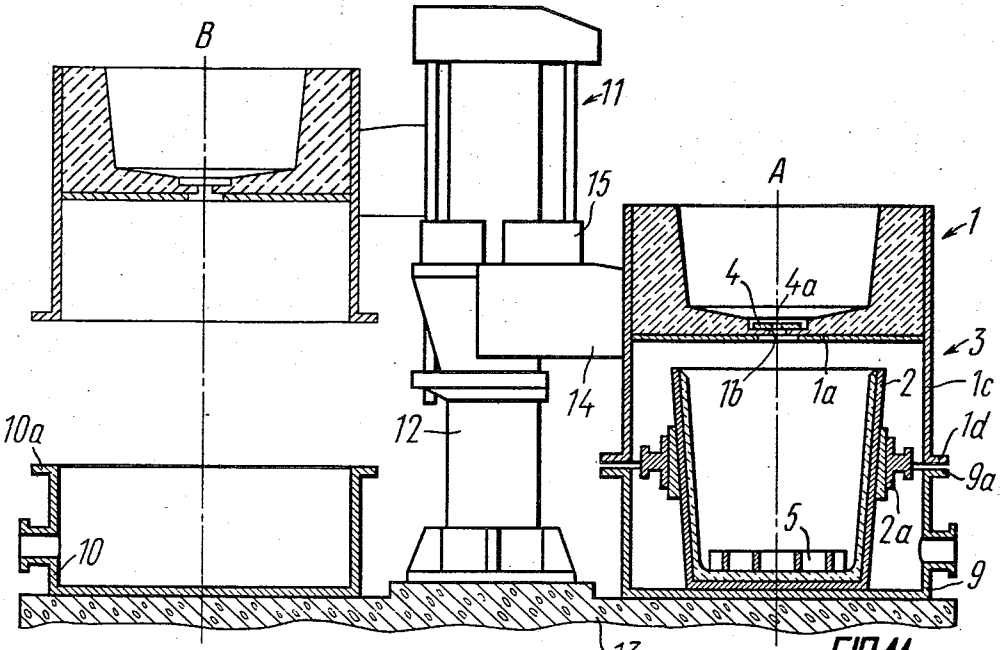
FIG. 11 shows a longitudinal section of the inventive apparatus in a modification wherein the displacing mechanism is constructed in the form of a column and a cantilever provided with a drive.

In the cases where the inventive production process is to be carried out under conditions of frequently repeating cycles of out-of-furnace treatment of cast iron, the inventive apparatus is constructed as shown in FIG. 11. In accordance with this modification, the apparatus is provided with at least working positions A and B and has two (in accordance with the number of positions) ladles 2, one receiving tank 1 and one sealable chamber 3 being successively provided in each of the above positions.

The chamber 3 is constructed detachable and comprises in each position a housing (a housing 9 in position A, and a housing 10 in position B), and a cover. The cover is single for all the working positions and is constructed integral with the receiving tank 1 in the form of the bottom 1*a* thereof, and a shell 1*c* projecting below this bottom. The shell 1*c* is made cylindrical and is located symmetrically with respect to the opening 1*b* provided in the bottom 1*a*, and to the opening 4*a* in the insert 4. To connect the receiving tank 1 to a corresponding housing 9 or 10, a flange 1*d* is provided on the shell 1*c*, and a flange 9*a* (10*a*) is provided on the housing, a sealing gasket (not shown) being located between the housing and the shell.

The housings 9 and 10 are fixed with respect to one another and serve for placing the ladles 2 therewithin. The height of location of the flanges 9*a*, 10*a* on the housings 9, 10 and the height of location of the load trunnions 2*a* on the ladles 2 are such that with the ladle 2 installed into the chamber 3, the trunnions are disposed at the level of a flange of a corresponding housing. First, such an arrangement allows the above sealing gasket to be removed from a zone subjected to thermal loading (i.e. from the spiegel of the molten metal contained within the ladle 2), and secondly, provides for a free access to the trunnions 2*a* of the ladle 2 in the course of carrying out crane operations. Both the above circumstances result in an increase in the reliability of operation of the inventive apparatus under conditions of frequently repeating cycles of treating the molten metal.

The apparatus is further provided with a shifting mechanism 11 constructed, particularly, in the form of a column 12 fixed on a foundation 13, a cantilever 14 mounted on this column 12 for rotation about the axis thereof, and a drive 15 for progressive and rotary motion. The cantilever 14 is coupled to the drive 15 and is connected to the receiving tank 1, thereby providing for the possibility of shifting the latter in vertical and horizontal planes with respect to the housings 9, 10, and thus transfer said tank to a required working position. It should be also noted that the shift of the receiving tank 1 in the horizontal plane liberates a space below the ladle 2 being located in the given position, and thereby facilitates carrying out crane operations for mounting and removing the latter.

It is to be noted in this connection that it is inexpedient to provide the flanges 9*a*, 10*a* on the housings 9, 10 below the level of the trunnions 2*a* of the ladle 2, since such an arrangement will result only in the need to increase the vertical travel of the receiving tank 1 in the course of removing the ladle from the chamber 3.

The apparatus constructed in accordance with FIG. 11, operates as follows. When the receiving tank 1 is turned to the position B (shown in the dotted line) and its discharge opening 1*b* is closed with the insert 4 (either provided with the opening 4*a* or without this opening), the ladle 2 containing inoculating additives placed therewithin and the grate 5, if required, are disposed in the housing 9, following which this tank 1 is turned to the position A and jointed with the housing 9 by means of the shifting mechanism 11, thereby forming the sealable chamber 3 in this position (righthand in the figure).

The second ladle 2 is filled with a molten metal supplied from a melting furnace, transported by means of a crane (not shown) to the receiving tank 1 (disposed in the position A), and the molten metal is poured into this tank 1. Following this, the process of treating the molten metal (evacuation of air from the chamber 3, fusion of the insert 4, degassing of the molten metal, and its interaction with the inoculant) proceeds as described above for other modifications of the apparatus.

At the time when the process of treating the molten metal proceeds within the first ladle 2 in the position A, the emptied second ladle 2 is mounted into the housing 10 (to the position B), and another grate 5 and inoculating additives are charged onto the bottom of this ladle. After the treatment of the molten metal in the position A has terminated, the receiving tank 1 is transferred to the position B, another insert 4 is placed therewithin, and the tank is jointed with the housing 10—in such position the apparatus is prepared to the next cycle of treating the molten metal.

The first ladle 2 containing the treated molten metal and located in the position A, is extracted from the housing 9 by means of a crane and brought up for casting. The next cycle of treating the molten metal is accomplished in the position B, following which the emptied ladle 2 is transferred to the position A, charged with inoculating additives, etc.

Due to the presence of several working positions, the above modification of the apparatus makes it possible to produce, in accordance with the inventive production process, a cast iron possessing high mechanical properties, while ensuring a high capacity of the production process, which could have been achieved before only in the course of inoculating a molten metal in an open ladle (without treating with vacuum). A required rhythm of operation and high reliability of the apparatus in the process of operation are achieved as well.

The invention will now be explained in terms of specific embodiments of the inventive method of out-of-furnace treatment of cast iron by means of the above described apparatus.

EXAMPLE 1

Cast iron melted in an induction furnace of commercial frequency was treated in accordance with the inventive production process. The furnace had an acid lining. Prior to out-of-furnace treatment (after melting), the cast iron contained the following ingredients, weight, %:

carbon: 3.18
silicon: 2.23
manganese: 0.3
chromium: 0.16
sulphur: 0.03

A temperature of overheating the cast iron in the furnace was of 1470° C.

Mechanical properties of the starting cast iron were the following: ultimate strength of 20 kg/mm$^2$, elongation of 0.5%.

Out-of-furnace treatment was carried out at the following process parameters:

amount of molten treated at the same time,
mass, kg: 700
volume, dm$^3$: 105
amount of inoculating additives introduced into the molten metal, weight % (relative to the molten metal mass): 1
composition of inoculating additives, weight %:
magnesium—8.9; rare-earth metals of cerium group—2.22; calcium—14.3; silicon—49; iron—the balance grain size of inoculating additives, mm: from 0.3 to 20
temperature of the molten metal just before its supply into the receiving tank of the inventive apparatus for treatment, °C.: from 1410 to 1440
working vacuum within the sealed chamber of the inventive apparatus, mm Hg: from 5 to 20

The treatment was carried out in the following sequence. A ladle having a capacity of 700 kg (on the basis of cast iron) and heated to a temperature of 500° C., was installed within a housing of a sealable chamber in the position A (FIG. 11). Inoculating additives were placed onto the bottom of the ladle and uniformly distributed over the bottom area. The height of the layer of additives was of 40 mm. Following this, the receiving tank was hermetically jointed with the housing along the flange of the shell by means of a shifting mechanism. A diameter D of the discharge opening provided in the receiving tank was 30 mm, i.e. corresponded to the following formula: $D=2.93\sqrt{V}$, thereby satisfying the conditions: $1.5<K<5$. The discharge opening was closed with a cast iron insert constructed in the form of a solid (without an opening) disc having a thickness of 3 mm.

A portion of the molten metal intended for treatment was poured into an intermediate ladle similar to that installed within the sealable chamber. A certain amount of this molten metal was then poured into the receiving tank of the apparatus, which resulted in the formation of a hydraulic seal in the zone of the discharge opening. Following this, the sealable chamber (which had become completely gas-tight) was connected to a system of air evacuation. In the process of evacuation of air there occured simultaneous dissolution of the insert under the effect of the molten metal, and after the working vacuum had been established within the chamber, a stream of the molten metal started coming through the discharge opening of the receiving tank and into the ladle, while passing through an evacuated space of the gas-tight chamber and then getting onto the layer of inoculating additives laid within the ladle.

From the moment of discharging the molten metal from the receiving tank, its level within this tank started lowering. This fact indicated the beginning of the process of degassing the molten metal (in-stream degassing), and the count of the duration of said process was carried out from this moment. Upon determining the starting moment of degassing, the remaining molten metal was poured into the receiving tank from the intermediate ladle.

The hydraulic seal was maintained within the receiving tank during all the time of pouring the molten metal from this tank into the ladle installed within the sealed chamber. After the termination of pouring operation, air started coming into this chamber through the discharge opening of the receiving tank, which resulted in the equalization of pressures inside and outside the chamber. The moment of the beginning of air supply was determined by the appearance of a characteristic noise—this moment indicated the termination of the process of degassing the molten metal. The time of degassing was 32 s.

The emptied (intermediate) ladle was installed into a free housing (to the position B). The receiving tank was transferred into an intermediate position by means of the shifting mechanism, and the ladle containing the treated molten metal was brought from the position A to a casting section where samples for mechanical tests and metallographic analysis were then cast.

The results of treatment of cast iron were following:

graphite form: spheroidal and vermicular
ultimate strength, kgf/mm$^2$: 49
elongation, %: 5

An insignificant amount of slag was present on the surface of the molten metal within the ladle.

For the purpose of comparison, given below are the data on the variation of the properties of cast iron in accordance with the prior art production process, said data specified in the above mentioned Japanses Patent No. 48-17967:

ultimate strength, kgf/mm$^2$:
before treatment: 18
after treatment: 30
elongation, %:
before treatment: 0.5
after treatment: 0.9

As can be seen from the comparison of these and above specified data, the cast iron (which has practically the same starting properties) acquires much more high mechanical properties as a result of treatment in accordance with the inventive production process.

EXAMPLE 2

Cast iron was treated mainly as specified in Example 1. The diameter of the discharge opening of the receiving tank was changed to 25 mm ($K=2.44$). The time of degassing was 40 s. The results of treatment were the following:

graphite form: spheroidal and vermicular
ultimate strength, kg/mm$^2$: 42
elongation, %: 3.5

EXAMPLE 3

Cast iron was treated mainly as specified in Example 1. The diameter of the discharge opening of the receiving tank was changed to 40 mm ($K=3.9$). The time of degassing was 19 s.

The results were the following:

graphite form: spheroidal and vermicular
ultimate strength, kgf/mm$^2$: 47
elongation, %: 4.5

EXAMPLE 4

Cast iron was treated mainly as specified in Example 1. The diameter of the discharge opening of the receiving tank was changed to 50 mm (K≃5). The time of degassing was 13 s.

The results of treatment were the following:
graphite form: spheroidal and vermicular
ultimate strength, kgf/mm²: 40
elongation: 3.5

EXAMPLE 5

Cast iron was treated mainly as specified in Example 1. The diameter of the discharge opening of the receiving tank was changed to 15 mm (K≃1.5). The time of degassing was 119 s.

The results of treatment were the following:
graphite form: vermicular
ultimate strength, kgf/mm²: 30
elongation, %: 2

EXAMPLE 6

Cast iron was treated mainly as specified in Example 1. The diameter of the discharge opening of the receiving tank was changed to 60 mm, i.e. the value of the coefficient "K" was higher than the recommended value and constituted 5.85. The time of degassing was 6 s.

The results of treatment were the following:
graphite form: vermicular
ultimate strength, kgf/mm²: 34
elongation, %: 3

In spite of satisfactory mechanical properties of the cast iron thus produced, the process of treatment was accompanied by the formation of a considerable amount of slag on the surface of the molten metal, and abundant emission of fumes. Moreover, bright flashes on the surface of the molten metal and outbursts of the latter beyond the ladle took place.

EXAMPLE 7

Cast iron was treated mainly as specified in Example 1. The diameter of the discharge opening was changed to 13 mm, i.e. the value of the coefficient "K" was lower than the recommended value and constituted 1.27. The time of degassing was 200 s.

The results of treatment were the following:
graphite form: lamellar
ultimate strength, kgf/mm²: 20
elongation, %: 0.5

As a result of significant heat losses of the molten metal in the course of passage through the discharge opening of the receiving tank, the molten metal solidified on the surface of the layer of inoculating additives, which fact prevented the progress of the process of inoculation.

EXAMPLE 8

Cast iron was treated mainly as specified in Example 1. Prior to charging the inoculating additives, a flat metallic grate was laid onto the bottom of the ladle, the form of said grate being close to circular. The maximum dimension of the grate, when viewed from above, was substantially similar to the inner diameter of the ladle bottom, while the height of said grate was 40 mm, i.e. was similar to the height of the layer of inoculating additives which were then charged. The grate was provided with cells having a size of 70×70 mm, the thickness of partitions therebetween being of 5 mm. The time of degassing the molten metal was 30 s.

The results of treatment were the following:
graphite form: spheroidal
ultimate strength, kgf/mm²: 62
elongation, %: 5.7

EXAMPLE 9

Cast ion was treated mainly as specified in Example 1. However, an opening having a diameter of 7.5 mm (K=0.25) was provided in the insert closing the discharge opening of the receiving tank. First, in the course of pouring the molten metal from the receiving tank into the ladle, said molten metal was flowing in a thin stream, and when the level of the molten metal within the ladle lifted to a height of 40 mm (i.e. reached the surface of the layer of inoculating additives), the insert melted down and the molten metal started flowing in a broad stream.

The time of pouring the molten metal was 42 s. It should be noted that, unlike the preceding examples, in the given case the time of pouring does not coincide completely with the time of degassing and is essentially longer. This fact is caused by that the time of pouring includes not only the time of degassing under a working vacuum, but also a time interval from the moment of the beginning of pouring to the moment of establishing this vacuum within the sealable chamber. The time of degassing is somewhat shorter than that in Example 1 (although the diameter of the discharge opening of the receiving tank was the same) since a portion of the molten metal has come into the ladle prior to establishing the working vacuum within the chamber, and for this reason a smaller mass of the molten metal has been subjected to degassing at said vacuum.

The results of treatment were the following:
graphite form: spheroidal
ultimate strength, kgf/mm²: 60
elongation, %: 5.5

EXAMPLE 10

Cast iron was treated mainly as specified in Example 8. The amount of inoculating additives was reduced to 0.5 weight %. The time of degassing the molten metal was 31 s.

The results of treatment were the following:
graphite form: vermicular
ultimate strength, kgf/mm²: 39
elongation, %: 3

While particular embodiments of the inventive method and apparatus for out-of-furnace treatment of cast iron have been shown and described, various modifications thereof will be apparent to those skilled in the art and therefore it is not intended that the invention be limited to the disclosed embodiments or to the details thereof and the departures may be made therefrom within the spirit and scope of the invention as defined in the appended claims.

We claim:

1. A process of treating molten cast iron out-of-the-furnace, comprising the steps of supplying a ladle with innoculant additives for said molten cast iron, placing said ladle within a substantially enclosed chamber, applying a continuous source of vacuum to said chamber, feeding a stream of molten cast iron to said ladle within said chamber, said stream of molten cast iron being subjected to said vacuum source prior to its interaction with the additives in said ladle, and maintaining said molten cast iron so fed to said ladle under said vacuum source for a period of 15 to 120 seconds.

2. The method according to claim 1 including the step of degassing said molten metal by removing the volatile gases simultaneous with the vacuum source.

3. The method according to claim 2 including the step of arranging said innoculant additives on the bottom of said ladle and removing a portion of the heat of said molten metal simultaneously with its contact with said additives.

4. The method according to claim 3 wherein the heat is removed from said molten metal by the step of arranging a radiator onto the bottom of said ladle together with said additives.

5. The method according to claim 3 wherein the heat is removed from said molten metal by the step of varying the flow rate of the stream of molten metal from a minimum rate at the initial stage of feeding for a period of time in which the level of the molten metal in said ladle is raised to the surface of said additives, and thereafter to a maximum value.

6. The method according to claim 5 wherein the variation in flow rate is obtained by the step of varying the diameter of the stream of molten metal.

7. Apparatus for the out-of-furnace treatment of cast iron comprising an enclosed chamber having an inlet opening in its top wall, a ladle movable into and out of said housing, a tank for receiving a quantity of molten cast iron locatable above said upper wall and sealing said inlet opening, a discharge opening smaller than said inlet opening located in the bottom of said tank in registry with said inlet opening, an insert closing said discharge opening, and means for evacuating air and gas from said chamber, said discharge opening having a diameter satisfying the condition: $D=K\sqrt{V}$ wherein D is the diameter of the opening in millimeters; V is the volume of molten metal treated in $dm^3$; and K is a proportionality factor having a magnitude from from 1.5 to 5, said insert being formed of a material meltable within a predetermined period of time on contact with said molten metal.

8. The apparatus according to claim 7 including a radiator, located in the bottom of said ladle.

9. The apparatus according to claim 8 wherein said radiator is provided with receptacle for receiving innoculating additives for said molten metal.

10. The apparatus according to claim 7 wherein said insert is provided with an opening having a diameter smaller than said discharge opening and a substantially coaxial with said discharge opening, the diameter of the opening in said insert being from 0.2 to 0.3 the diameter of said discharge opening of said tank.

11. The apparatus according to claim 7, having at least two working positions and having a corresponding number of said ladles, one said receiving tank, and one said sealable chamber, said chamber being made detachable and comprising in each position a housing and a cover, both provided with connecting flanges, the number of said housings in the apparatus corresponding to the number of working positions thereof, and each of said housings is stationarily mounted with respect to other housings and serves to receive one of said ladles therewithin, said cover being single for all the working positions and is constructed integral with said receiving tank in the form of said bottom thereof and a shell projecting below said bottom, said shell being disposed concentrically relative to the openings provided in this bottom and said insert, said apparatus being further provided with a shifting mechanism for transferring said receiving tank to a required working position and for forming in this position said sealable chamber when said shell of said tank and a corresponding housing are joined together and the height of location of said flange on each of these housings and the height of location of load trunnions on each of said sealable chamber, the trunnions thereof are disposed at the level of said flange of said housing.

12. The apparatus as claimed in claim 10, wherein said shifting mechanism comprises a column having a cantilevered arm mounted thereon and connected to said receiving tank, and a drive for progressive and rotary motion, coupled with the cantilevered arm for shifting the latter in vertical and horizontal planes relative to said housings.

* * * * *